United States Patent [19]

Nakajima

[11] 4,298,827

[45] Nov. 3, 1981

[54] POWER SOURCE CIRCUIT FOR A FLASH DISCHARGE LAMP

[75] Inventor: Yahei Nakajima, Himeji, Japan

[73] Assignee: Ushio Denki Kabushikikaisha, Tokyo, Japan

[21] Appl. No.: 98,990

[22] Filed: Nov. 30, 1979

[30] Foreign Application Priority Data

Dec. 1, 1978 [JP] Japan ..... 53-164567

[51] Int. Cl.[3] ..... H05B 41/34

[52] U.S. Cl. ..... 315/241 R; 315/208; 315/225; 320/1

[58] Field of Search ..... 315/208, 241 R, 241 P, 315/225; 320/1; 355/69; 307/252 B, 252 UA

[56] References Cited

U.S. PATENT DOCUMENTS 3,780,344 12/1973 Paget ..... 315/241 R 4,075,536 2/1978 Stevens ..... 320/1 X

FOREIGN PATENT DOCUMENTS 517190 5/1978 U.S.S.R. ..... 315/241 R

*Primary Examiner*—Eugene R. La Roche

*Attorney, Agent, or Firm*—Staas & Halsey

[57] ABSTRACT

A power source circuit for a flash discharge lamp which includes a booster-rectifier, a thyristor connected to the booster-rectifier on the side of a power source, a discharge capacitor connected to the booster-rectifier on the side of a load, a detecting element for detecting a voltage across the discharge capacitor, a trigger circuit and a control circuit. The control circuit is adapted to supply, to the gate of the thyristor, an AC signal of substantially the same phase as the power source and to stop the AC signal supply when the voltage of the discharge capacitor reaches a predetermined value, thereby preventing the thyristor from noise generation which would otherwise cause a malfunction in a computer which processes facsimile or like picture signals.

6 Claims, 7 Drawing Figures

POWER SOURCE CIRCUIT FOR A FLASH DISCHARGE LAMP

BACKGROUND OF THE INVENTION

1. Field of the Invention

This invention relates to a power source circuit for a flash discharge lamp which is required for fixing toner on the electrostatic recording paper of a facsimile, printer, etc. by irradiation from the flash discharge lamp.

2. Description of the Prior Art

One prior art power source circuit for a discharge flash lamp comprises a booster-rectifier including a transformer and a full-wave rectifier, a thyristor connected to the booster-rectifier on the side of the power source, a discharge capacitor connected to the booster-rectifier on the side of a load, a detecting element for detecting a voltage across the discharge capacitor, a trigger circuit, and a control circuit for controlling the thyristor. The thyristor is phase controlled by the control circuit to cause the voltage of the discharge capacitor to have a predetermined value. This circuit is set forth, for example, in Japanese Utility Model Disclosure No. 89870/77 "Power Source Device for Flash Discharge Lamp".

FIG. 1 illustrates the above-mentioned conventional power source circuit. Reference numeral 1 indicates an AC power source; 50 designates a charging circuit including a resistor 8 for detecting a voltage across a discharge capacitor 6. The charging circuit 50 comprises a transformer 3, a rectifier 4, a charging resistor 5 and other resistors provided as required. Trigger circuit 51 includes a trigger switch 12, resistors 9 and 10, a capacitor 11 and a pulse transformer 13. Reference numeral 2 denotes a thyristor connected between the AC power source 1 and the charging circuit 50; 52 represents a thyristor control circuit, which includes a comparator 19 for receiving a signal from the above-mentioned resistor 8, a capacitor 21 for activating a unijunction transistor 23, a transformer 15, a resistor 16, a rectifier 17, a Zener diode 18 for voltage stabilization use, a pulse transformer 24 and resistors 20 and 22. Pulse signals a and b from the thyristor control circuit 52 serve as control signals for the thyristor 2.

In the above described power source circuit, a control circuit 53, for the capacitor 21 for activating the unijunction transistor 23, includes a switch 25 ganged with the trigger switch 12 and a transistor connected to the above-mentioned capacitor 21. A drive circuit 54 cooperates with and drives the control circuit 53.

The control circuit 53 and the drive circuit 54 are shown in detail in FIG. 2. In FIG. 2, reference numeral 25 indicates the switch ganged with the aforementioned trigger switch; 55 designates a commercially available monostable circuit; and 56 identifies a differentiation circuit. When the switch 25 is closed, a drive circuit for the transistor 26 is formed. The drive circuit comprises the differentiation circuit 56 and the monostable circuit 55, and it operates to generate a pulse having a pulse width which is dependent upon the time constants of a capacitor $C_4$ and a resistor $R_6$ at the output stage of the monostable circuit 55. During the pulse, the transistor 26 is held in its conductive state. Accordingly, if the collector of the transistor 26 is connected, via a terminal 53*c*, to the capacitor 21, no charges are stored therein during the duration of the pulse, so that the signal generation from the thyristor control circuit 102 is stopped, resulting in the thyristor 2 becoming nonconductive. Thus, occurrence of the glow discharge state can surely be prevented.

The drive circuit 54 has input terminals 54*a* and 54*b*, output terminals 54*c* and 54*d* and a Zener diode 27 for output voltage stabilization use and functions as a DC stabilizing power source and is connected to input terminals 53*a* and 53*b* of the capacitor control circuit 53.

In this conventional power source device, when the trigger switch 12 is closed to cause the flash discharge lamp 14 to radiate, the drive circuit 54, the capacitor control circuit 53 and the thyristor 52 operate to retain the thyristor 2 in its nonconductive state for a certain period of time, thereby insuring that glow discharge of the flash discharge lamp is prevented.

However, according to package tests of actual toner fixation in an electronic copying machine, it has been found that noise generation is very great in the above-mentioned conventional power source device. A close examination shows that when conducting the thyristor for controlling its phase, a large amount of noise is generated at an abrupt fall in the voltage waveform.

SUMMARY OF THE INVENTION

An object of this invention is to provide a power source device for flash discharge lamps which is designed to minimize the noise generation in the control of a thyristor, wherein an AC signal of substantially the same phase as the power source voltage is applied to the gate of the thyristor.

DESCRIPTION OF THE PREFERRED EMBODIMENTS

Figure 1:
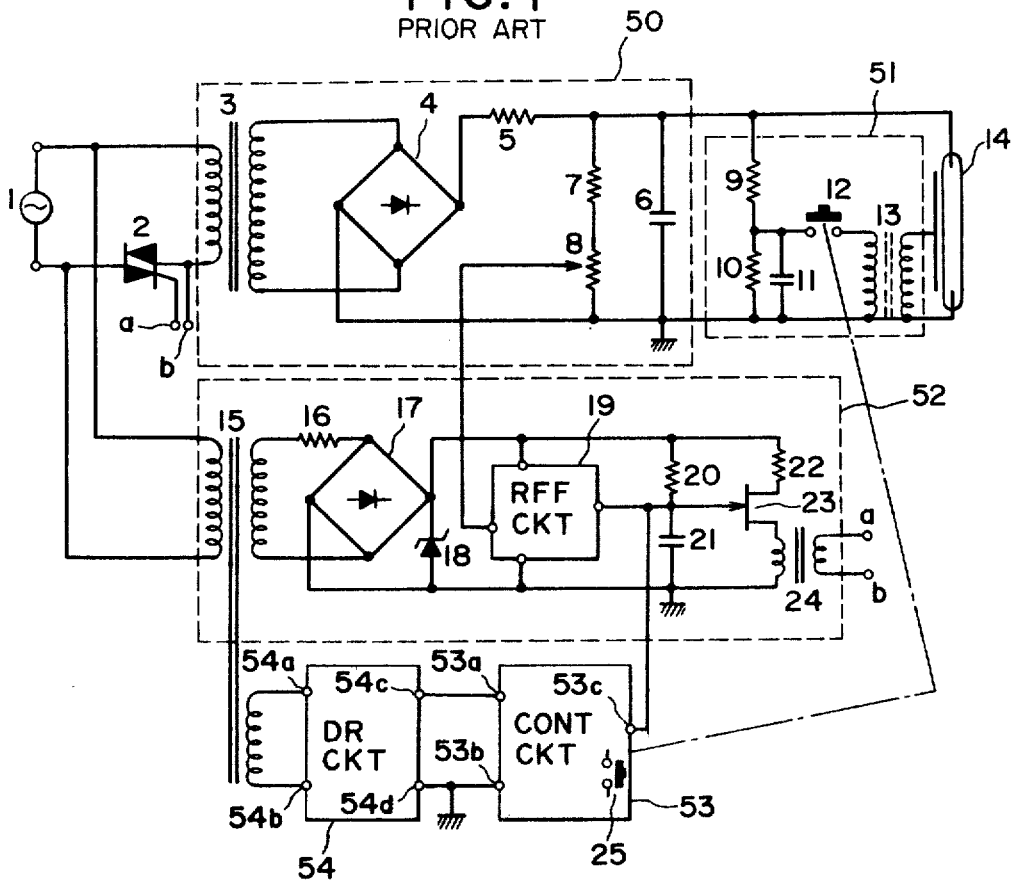
FIG. 1 PRIOR ART
FIG. 1 is a circuit diagram of a conventional power source device.
Figure 2:
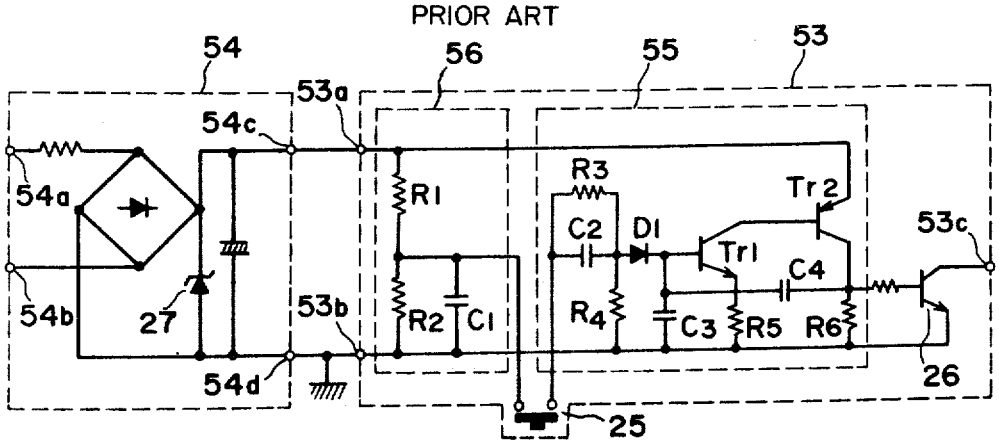
FIG. 2 PRIOR ART
FIG. 2 is a circuit diagram showing in detail the drive circuit 54 and the control circuit 53 of the circuit of FIG. 1.
Figure 3:
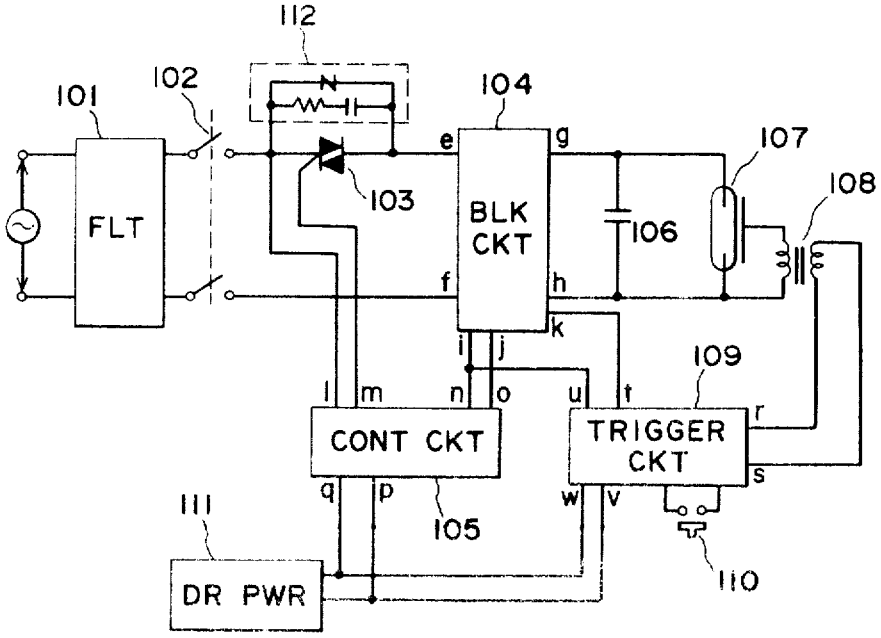
FIG. 3 is a block diagram illustrating the power source circuit of the present invention.

FIG. 3 shows in block form the power source circuit of the present invention. Reference numeral 101 indicates a noise filter; 102 designates a power source switch; 103 identifies a thyristor; 104 denotes a circuit including a booster-rectifier comprising a transformer, rectifier and a detecting element; 105 designates a control circuit for the thyristor 103; 106 designates a discharge capacitor; 107 refers to a flash discharge lamp; 108 indicates a trigger coil; 109 designates a trigger circuit; 110 identifies a trigger switch; 111 denotes a drive power source; and 112 represents a protecting circuit. An example of the thyristor control system in the above-mentioned power source circuit will be described below with reference to examples of the block circuit 104 shown in FIGS. 4 and 5 and an example of the control circuit shown in FIG. 6.

Figure 4:
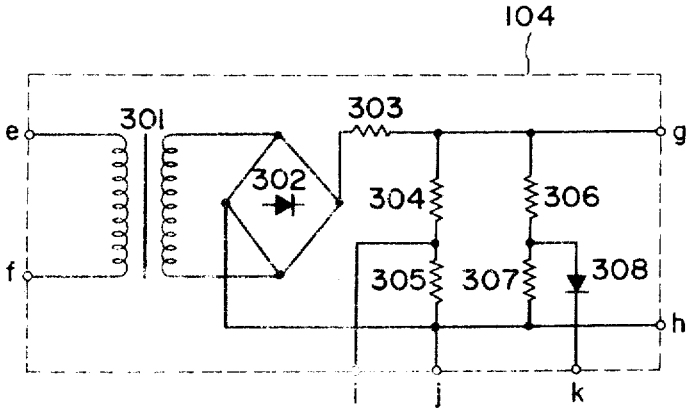
FIG. 4 is a circuit diagram showing in detail an example of the circuit 104, including a booster-rectifier, of the circuit of FIG. 3.
Figure 5:
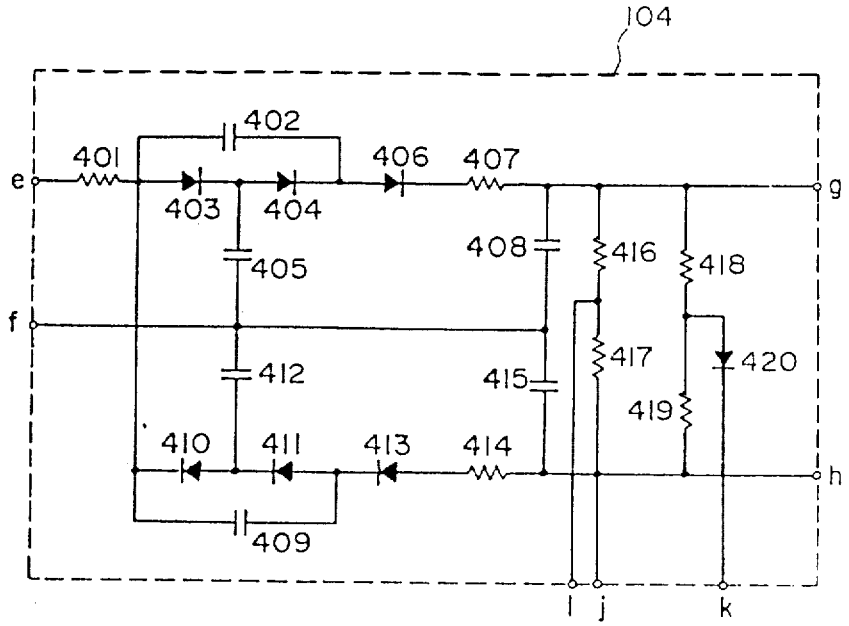
FIG. 5 is a circuit diagram showing in detail another embodiment of the circuit 104 of FIG. 3.

FIG. 4 illustrates one embodiment of the circuit 104 of the power source circuit, which employs a transformer for the boosting system. FIG. 5 illustrates an embodiment using a 6-fold voltage full-wave rectifying system. Both embodiments produce the same operating effect; therefore, the present invention will be described with regard to FIG. 4.

When the power source switch 102 is closed to start charging of the discharge capacitor 106, the charging voltage is divided by resistors 304 and 305 and derived as a signal (i, j).

Figure 6:
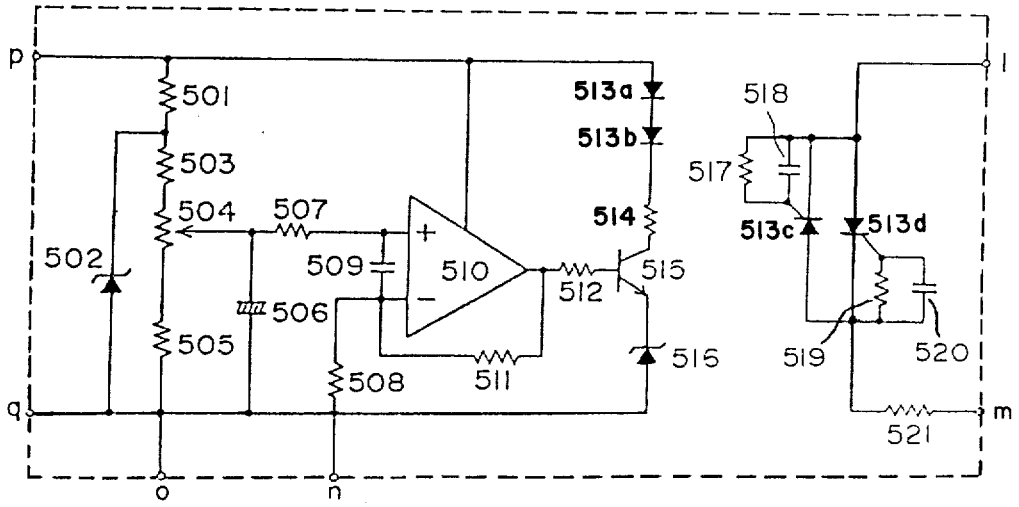
FIG. 6 is a circuit diagram illustrating a control circuit for use in the present invention.

The signal (i, j) is applied as a comparison signal (n, o) in FIG. 6 for comparison with a drive power source signal (p, q).

In FIG. 6, a non-inverted input signal voltage (+) of an operational amplifier 510 is formed by the signal (p, q), whereas an inverted input signal voltage (−) is formed by the signal (n). Where the non-inverted input signal voltage is larger than the inverted input signal voltage, the output voltage of the operational amplifier 510 is substantially close to the drive power source voltage and is applied via a resistor 512 to the base of a transistor 515. If this input voltage is higher than the voltage of a Zener diode 516, the transistor 515 conducts, so that an electrically isolated switch 513 a-d conducts, and accordingly a signal (l, m) becomes an AC signal of the same phase as the power source voltage. The switch 513 comprises, for example, light emitting diodes 513*a* and 513*b*, and light controlled thyristors 513*c* and 513*d*. Conversely, when the inverted input signal voltage exceeds the non-inverted input signal voltage, the output voltage of the operational amplifier 510 drops, for example, by 2 to 3 V. Accordingly, if the voltage of the Zener diode 516 is set midway between the value of the drive power source voltage and the reduced value of the above-mentioned output voltage, for example, a little higher than 3 V in the above case, the transistor 515 does not conduct, and consequently the electrically isolated switch 513*a–d* does not conduct, so that the signal (l, m) becomes 0.

Accordingly, until the voltage of the discharge capacitor 106 reaches a predetermined value in accordance with the non-inverted input signal voltage (+) of the operational amplifier 510, produced by the drive power source signal (p, q), the non-inverted input signal voltage (−) of the operational amplifier 510, produced by the voltage division of the charging voltage of the discharge capacitor 106 and the set voltage of the Zener diode 516, the AC signal of the same phase as the power source voltage is applied to the gate of the thyristor 103. Thus, the discharge capacitor 106 is continuously charged, and at the moment when the predetermined value is reached, the gate of the thyristor 103 receives the signal 0 and becomes nonconductive, thereby stopping the charging of the discharge capacitor 106.

In the same manner as described above, the charging voltage of the discharge capacitor 106 can be controlled to have a predetermined value. As described above, the thyristor 103 is controlled by an AC signal of the same phase as the power source voltage unlike in the phase control system; accordingly, there is no abrupt fall in the power source voltage and hence substantially no noise generation occurs.

Thus, the power source device for flash discharge lamps according to the present invention has the advantage that the noise generation in the controlling of the thyristor connected to the booster-rectifier on the side of the power source to control the charging voltage of the discharge capacitor is minimized.

Figure 7:
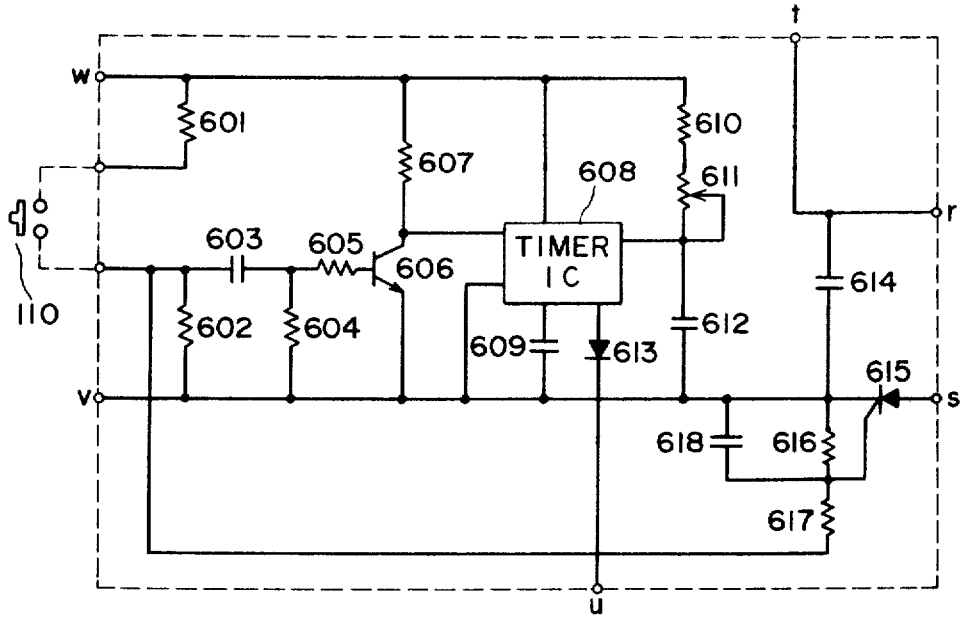
FIG. 7 is a circuit diagram illustrating a trigger circuit for use in the present invention.

FIG. 7 illustrates, by way of example, the trigger circuit 109 for use in the present invention. The illustrated circuit arrangement provides a signal u for stopping the function of the operational amplifier 510. The signal is provided in order to prevent a glow discharge which accompanies the firing of the flash discharge lamp. In FIG. 7, reference numerals 601, 602, 604, 605, 607, 610, 616 and 617 indicate resistors; 603, 609, 612, 614 and 618 designate capacitors; 606 identifies a transistor; 613 denotes a diode; 615 represents a thyristor; 608 designates a timer formed by an integrated circuit; and 611 refers to a variable resistor.

It will be apparent that many modifications and variations may be effected without departing from the scope of the novel concepts of this invention.

What is claimed is:

1. A power source circuit for a flash discharge lamp, comprising:

a power source;

a booster-rectifier circuit, having an input and an output;

a thyristor operatively connected to the input of said booster-rectifier circuit and operatively connected to said power source;

a discharge capacitor operatively connected to the output of said booster-rectifier circuit;

said booster-rectifier circuit including a detecting means for detecting a voltage across said discharge capacitor;

a trigger circuit; and a control circuit, operatively connected to said detecting means and said thyristor, for controlling said thyristor;

said control circuit including means for providing an AC signal of substantially the same phase as the power source to the gate of said thyristor until the voltage of said discharge capacitor reaches a predetermined valve.

2. A power source circuit, having a power source, for a flash discharge lamp, comprising:

a booster-rectifier circuit for generating a charging signal;

a thyristor operatively connected to said booster-rectifier circuit and to the power source;

a discharge capacitor, operatively connected to said booster-rectifier circuit, for receiving said charging signal, and operatively connected to the flash discharge lamp;

a control circuit, operatively connected to said booster-rectifier circuit and said thyristor, for controlling said thyristor; and drive power source means, operatively connected said control circuit, for generating a drive power source signal;

said booster-rectifier circuit including a detecting means, operatively connected to said control circuit, for detecting the voltage across said discharge capacitor;

said control circuit including means for providing an AC signal of substantially the same phase as the power source to the gate of said thyristor until the voltage of said discharge capacitor reaches a predetermined value.

3. A circuit as set forth in claim 2, wherein said control circuit comprises:

an operational amplifier, having an inverted input operatively connected to the said detecting means, having a non-inverted input, operatively connected to said drive power source means, for receiving said drive power source signal, and having an output;

a transistor operatively connected to the output of said operational amplifier;

a Zener diode operatively connected to said transistor and to said drive power source means; and an electrically isolated switch, operatively connected to said transistor, for providing the AC signal of substantially the same phases of the power source to the gate of said thyristor until the voltage of said discharge capacitor reaches a predetermined value.

4. A circuit as set forth in claim 3, wherein said transistor has a base operatively connected to the output of said operational amplifier, an emitter operatively connected to said Zener diode, and a collector operatively connected to said electrically isolated switch.

5. A circuit as set forth in claim 3 or 4, wherein said booster-rectifier circuit comprises:

a transformer operatively connected to said thyristor and to the power source;

a rectifier operatively connected to said transformer and operatively connected to said discharge capacitor at a first node;

a first resistor operatively connected to said rectifier and operatively connected to said discharge capacitor at a second node;

a second resistor operatively connected to said detecting means and operatively connected at said second node;

a third resistor operatively connected at said second node;

a fourth resistor operatively connected to said third resistor and operatively connected at said first node.

6. A circuit as set forth in claim 5, wherein said detecting means comprises a detecting resistor having a first terminal operatively connected to said inverted input of said operational amplifier and to said second resistor, and having a second terminal operatively connected at said first node.

* * * * *